US009464251B2

(12) United States Patent
Paggi et al.

(10) Patent No.: US 9,464,251 B2
(45) Date of Patent: Oct. 11, 2016

(54) CYCLIC DIENE OR CYCLIC TRIENE-BASED DIESEL FUEL ADDITIVE

(71) Applicant: Silverthorn Industries LLC., Las Vegas, NV (US)

(72) Inventors: Raymond Edward Paggi, Winchester, VA (US); Tony Lewis Shortall, Brownsburg, IN (US)

(73) Assignee: SILVERTHORN INDUSTRIES LLC., Las Vegas, NV (US)

( * ) Notice: Subject to any disclaimer, the term of this patent is extended or adjusted under 35 U.S.C. 154(b) by 0 days.

(21) Appl. No.: 14/699,309

(22) Filed: Apr. 29, 2015

(65) Prior Publication Data

US 2015/0315503 A1 Nov. 5, 2015

Related U.S. Application Data

(60) Provisional application No. 61/996,194, filed on May 2, 2014.

(51) Int. Cl.

| | |
|---|---|
| ***C10L 1/23*** | (2006.01) |
| ***C10L 1/16*** | (2006.01) |
| ***C10L 10/02*** | (2006.01) |
| ***C10L 1/14*** | (2006.01) |
| ***C10L 10/12*** | (2006.01) |

(52) U.S. Cl.

CPC .. *C10L 1/16* (2013.01); *C10L 1/14* (2013.01); *C10L 1/231* (2013.01); *C10L 10/02* (2013.01); *C10L 10/12* (2013.01); *C10L 1/1608* (2013.01); *C10L 1/1616* (2013.01); *C10L 2200/0259* (2013.01); *C10L 2200/043* (2013.01); *C10L 2200/0446* (2013.01); *C10L 2200/0476* (2013.01); *C10L 2230/22* (2013.01); *C10L 2270/026* (2013.01)

(58) Field of Classification Search

CPC ..... C10L 1/16; C10L 10/12; C10L 1/231; C10L 1/14; C10L 10/02; C10L 2200/0446; C10L 2230/22; C10L 2200/0259; C10L 1/1608; C10L 2270/026; C10L 1/1616; C10L 2200/043; C10L 2200/0476

USPC ..... 44/300, 324

See application file for complete search history.

(56) References Cited

U.S. PATENT DOCUMENTS

| | | | | |
|---|---|---|---|---|
| 3,105,084 | A * | 9/1963 | Wilkinson | C06B 23/007 44/361 |
| 4,131,434 | A * | 12/1978 | Gonzalez | C10L 1/14 44/413 |
| 5,906,662 | A * | 5/1999 | McCombes | C10L 1/003 44/300 |
| 8,470,058 | B2 | 6/2013 | Paggi | |
| 2004/0060229 | A1* | 4/2004 | Todd | C10L 1/143 44/603 |
| 2005/0229479 | A1* | 10/2005 | Fernandes | C10L 10/10 44/329 |
| 2012/0036766 | A1* | 2/2012 | Paggi | C10L 1/14 44/324 |
| 2013/0298861 | A1* | 11/2013 | Lee | C10L 1/04 123/1 A |

FOREIGN PATENT DOCUMENTS

| | | | | |
|---|---|---|---|---|
| WO | WO 2012064740 A1 * | 5/2012 | | C10L 1/04 |

* cited by examiner

*Primary Examiner* — Pamela H Weiss

(74) *Attorney, Agent, or Firm* — Welsh Flaxman & Gitler LLC

(57) ABSTRACT

A fuel additive includes 50 wt. % to less than 75 wt. % cyclic dienes and/or cyclic trienes that thermally crack into only chain branching radicals and greater than 25 wt. % to 50 wt. % organo-nitrates and/or nitro-organics. The fuel additive is combined with fuel at a combined treat rate ranging from 1000 (wt.) ppm to 3000 (wt.) ppm.

20 Claims, 1 Drawing Sheet

| | | | | | | | | | |
|---|---|---|---|---|---|---|---|---|---|
| | | | | ULSD (Ultra Low Sulfur Diesel) density | 0.8257 | | | | |
| | | | | ULSD grams/gallon | 3125 | | | | |
| Component | Density, g/ml | Weight per treated gallon of ULSD, g | Concentration in treated fuel, ppm | Concentration in Fuel Additive, wt % | | Weight per gallon of Fuel Additive, g | Volume per treated gallon of ULSD, ml | Volume per gallon of Fuel Additive, ml | Concentration in Fuel Additive, Volume % |
| 1-methyl-4 (1 methylethenyl)-cyclohexene | 0.8411 | 2.1 | 671 | 29.2% | | 942.4 | 2.50 | 1120.4 | 29.6% |
| 2 ethylhexyl nitrate | 0.96 | 2.1 | 671 | 29.2% | | 942.4 | 2.19 | 981.7 | 25.9% |
| Nitrobenzene | 1.2 | 0 | 0 | 0.0% | | 0.0 | 0.00 | 0.0 | 0.0% |
| kerosene | 0.8 | 3 | 958 | 41.7% | | 1346.3 | 3.75 | 1682.9 | 44.5% |
| Total | 0.86 | 4.2 | 2300 | 100% | | 1884.8 | 8.43 | | 100.0% |
| | | | | | | 3231.1 | | 3785.0 | |
| | | | | | | 7123.3 | | | |
| | 7.01848 | 0.002299 | | treat rate, wt % | | | | | |
| | 8.01063 | 0.29 | | treat rate, oz/gal | | | | | |
| | 10.0133 | | | | | | | | |
| | | | | | | | | | |
| | | 448.8 | | gallons of fuel treated by 1 gallon of Fuel Additive | | | | | |

| | | | | | | | | | |
|---|---|---|---|---|---|---|---|---|---|
| | | | | ULSD (Ultra Low Sulfur Diesel) density | 0.8257 | | | | |
| | | | | ULSD grams/gallon | 3125 | | | | |
| | | | | | | | | | |
| Component | Density, g/ml | Weight per treated gallon of ULSD, g | Concentration in treated fuel, ppm | Concentration in Fuel Additive, wt % | | Weight per gallon of Fuel Additive, g | Volume per treated gallon of ULSD, ml | Volume per gallon of Fuel Additive, ml | Concentration in Fuel Additive, Volume % |
| 1-methyl-4 (1-methylethenyl)-cyclohexene | 0.8411 | 2.1 | 671 | 29.2% | | 942.4 | 2.50 | 1120.4 | 29.6% |
| 2 ethylhexyl nitrate | 0.96 | 2.1 | 671 | 29.2% | | 942.4 | 2.19 | 981.7 | 25.9% |
| Nitrobenzene | 1.2 | 0 | 0 | 0.0% | | 0.0 | 0.00 | 0.0 | 0.0% |
| kerosene | 0.8 | 3 | 958 | 41.7% | | 1346.3 | 3.75 | 1682.9 | 44.5% |
| Total | 0.86 | 4.2 | 2300 | 100% | | 1884.8 | 8.43 | | 100.0% |
| | | | | | | 3231.1 | | 3785.0 | |
| | | | | | | 7123.3 | | | |
| | 7.01848 | 0.002299 | | treat rate, wt % | | | | | |
| | 8.01063 | 0.29 | | treat rate, oz/gal | | | | | |
| | 10.0133 | | | | | | | | |
| | | | | | | | | | |
| | | 448.8 | | gallons of fuel treated by 1 gallon of Fuel Additive | | | | | |

CYCLIC DIENE OR CYCLIC TRIENE-BASED DIESEL FUEL ADDITIVE

CROSS REFERENCE TO RELATED APPLICATION

This application claims the benefit of U.S. Provisional Patent Application Ser. No. 61/996,194, entitled "DIESEL FUEL ADDITIVE," filed May 2, 2014.

BACKGROUND OF THE INVENTION

1. Field of the Invention

The present invention generally relates to diesel fuel. More particularly, the invention relates to a diesel fuel (or biodiesel fuel) additive composition comprising certain organo-nitrates and/or nitro-organic compounds with cyclic diene and/or cyclic triene that thermally decompose under high temperature to generate highly reactive radicals. When these compounds are combined in a fixed range of concentrations, significant performance and fuel economy benefits in a diesel engine are produced.

2. Description of the Related Art

In a diesel-fueled engine, the single-most limiting parameter is poor air utilization. The fuel is sprayed into the combustion chamber as a liquid stream when the piston is very close to top dead center, leaving very little time for atomization and mixing. Fuel will only burn when atomized and mixed with air, so the liquid fuel in the core of the spray begins to pyrolyze and form solid matter. Greater amounts of particulate matter are produced at higher loads, where relatively large amounts of fuel need to be atomized in less than a millisecond. Additionally, as more time is consumed to atomize the fuel, the production of $NO_x$ increases.

Engine manufacturers currently address this problem by installing very high pressure fuel injection equipment to assist in atomization. However, the pumping loss directly attributable to this high pressure injection robs 10% to 15% of the engine's energy output. Engine manufacturers also presently rely heavily on exhaust gas recirculation (EGR) to control $NO_x$ emissions. EGR, however, lowers the bulk gas temperature, lowers work output and causes combustion instability. The use of biodiesel further stresses the efficient execution of combustion due to its lower volatility and the high oxygen content of the fuel (>10% more oxygen content when compared with traditional diesel fuel). Moreover, the gums and deposits that the biodiesel tends to build on the injectors and in the combustion chamber itself compromise the combustion process.

Detergent fuel additives are well known as capable of restoring lost fuel economy and reducing exhaust emissions by removing deposits on injector nozzles and in the combustion chamber. Even so, these fuel additives cannot improve combustion beyond a clean engine. Metallic based fuel additives are also well-known combustion enhancing additives and can improve performance and reduce particulate matter formation in a diesel engine. However, these metal based additives are known to poison catalysts and have harmful effects on humans and the environment.

An improved way of quickly dispersing the liquid fuel spray and atomizing the fuel is desirable. There remains a need for a fuel additive technology which significantly enhances engine efficiency and reduces harmful exhaust emissions without imposing harmful side effects.

Applicant's prior U.S. Pat. No. 8,470,058 attempts to address this problem and teaches that a diesel fuel additive with a formulation of at least 75% 1-methyl-4 (1-methylethenyl)-cyclohexene and the remainder a cetane improver will yield measurable fuel economy benefits in medium and heavy duty diesel engines. This discovery was based upon combustion bomb tests that demonstrate an earlier pressure build in the combustion event and on-the-road heavy duty truck tests. The disclosure describes the most likely mechanism of action as early start of combustion resulting from enhanced atomization and mixing of the diesel fuel with the bulk air charge by the thermal cracking of 1-methyl-4 (1-methylethenyl)-cyclohexene along with the addition of a cetane improver to off-set the atomization of low cetane components. A concentration of cetane improver higher than 25% was shown in combustion bomb tests and road tests to diminish the benefit of the formulation. It was also well known that higher amounts of cetane improver adversely affect $NO_x$.

SUMMARY OF THE INVENTION

It is, therefore, an object of the present invention to provide a fuel additive including 50 wt. % to less than 75 wt. % cyclic dienes and/or cyclic trienes that thermally crack into only chain branching radicals and greater than 25 wt. % to 50 wt. % organo-nitrates and/or nitro-organics. The fuel additive is combined with fuel at a combined treat rate ranging from 1000 (wt.) ppm to 3000 (wt.) ppm.

It is also an object of the present invention to provide a fuel additive including 50 wt. % to 70 wt. % cyclic dienes and/or cyclic trienes and 30 wt. % to 50 wt. % organo-nitrates and/or nitro-organics.

It is another object of the present invention to provide a fuel additive wherein the cyclic diene is 1-methyl-4 (1-methylethenyl)-cyclohexene or norbornadiene.

It is a further object of the present invention to provide a fuel additive wherein the cyclic triene is cyclododecatriene.

It is also an object of the present invention to provide a fuel additive wherein the cyclic dienes and/or cyclic trienes are selected from the group consisting of 1-methyl-4 (1-methylethenyl)-cyclohexene, norbornadiene and cyclododecatriene.

It is another object of the present invention to provide a fuel additive wherein the organic nitrates and/or nitro-organics are selected from the group consisting of nitrobenzene nitropropane, nitrophenol, nitromethane, and 2 ethylhexyl nitrate.

It is a further object of the present invention to provide a fuel additive wherein the nitro-organics are nitrobenzene nitropropane, nitrophenol, and/or nitromethane.

It is also an object of the present invention to provide a fuel additive wherein the organo-nitrate is 2 ethylhexyl nitrate.

It is another object of the present invention to provide a diesel fuel or biodiesel fuel with a fuel additive including a diesel fuel or biodiesel fuel and a fuel additive. The fuel additive includes 50 wt. % to less than 75 wt. % cyclic dienes and/or cyclic trienes that thermally crack into only chain branching radicals and greater than 25 wt. % to 50 wt. % organo-nitrates and/or nitro-organics. The fuel additive is combined with the diesel fuel or biodiesel fuel at a combined treat rate ranging from 1000 (wt.) ppm to 3000 (wt.) ppm.

BRIEF DESCRIPTION OF THE DRAWING

FIG. 1 is a table showing an exemplary mixing of the present fuel additive with a diesel fuel.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

General Definitions

In this specification and in the claims that follow, reference will be made to a number of terms, which shall be defined to have the following meanings.

Throughout the description and claims of this specification the word "comprise" and other forms of the word, such as "comprising" and "comprises," means including but not limited to, and is not intended to exclude, for example, other additives, components, integers, or steps.

As used in the description and the appended claims, the singular forms "a," "an," and "the" include plural referents unless the context clearly dictates otherwise. Thus, for example, reference to "a composition" includes mixtures of two or more such compositions.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

References in the specification and concluding claims to parts by weight of a particular element or component in a composition denotes the weight relationship between the element or component and any other elements or components in the composition or article for which a part by weight is expressed. Thus, in a compound containing 2 parts by weight of component X and 5 parts by weight component Y, X and Y are present at a weight ratio of 2:5, and are present in such ratio regardless of whether additional components are contained in the compound.

A weight percent (wt. %) of a component, unless specifically stated to the contrary, is the weight of the component(s) divided by the total weight of the formulation or composition in which the component(s) is included.

The mathematical symbol "<" as used herein means "less than" and ">" means "greater than."

Chemical Definitions

As used herein, the term "substituted" is contemplated to include all permissible substituents of organic compounds. In one example, the permissible substituents can include acyclic and cyclic, branched and unbranched, carbocyclic and heterocyclic, and aromatic and nonaromatic substituents of compounds. Illustrative substituents include, for example, those described below. The permissible substituents can be one or more and the same or different for appropriate compounds. For purposes of this disclosure, the heteroatoms, such as nitrogen, can have hydrogen substituents and/or any permissible substituents of organic or inorganic compounds described herein which satisfy the valences of the heteroatoms. This disclosure is not intended to be limited in any manner by the permissible substituents of compounds.

A "cyclic diene" is a non-aromatic unsaturated carbon-based ring composed of two carbon double bonds between the carbon atoms. The cyclic diene can be substituted or unsubstituted.

A "cyclic triene" is a non-aromatic unsaturated carbon-based ring composed of three carbon double bonds between the carbon atoms. The cyclic triene can be substituted or unsubstituted.

The term "active radical" as used herein refers to an atom or group of atoms that has at least one unpaired electron and is therefore unstable and highly reactive.

The term "unsaturated" as used herein refers to any organic compound in which two or more of the carbon atoms are joined by a double or triple bond and therefore can be combined with additional atoms or radicals.

The term "organo-nitrate" as used herein refers to any organic compound with the $ONO_2$ functional group.

The term "nitro-organic" as used herein refers to any organic compound with the $NO_2$ functional group.

The present invention provides a diesel fuel (or biodiesel fuel) additive offering a fuel performance benefit when the concentration of a cetane improver in the form of an organo-nitrate, or non-cetane improvers in the form of nitro-organic compounds, (or combinations of the organo-nitrate and the nitro-organic) is increased to greater than 25% by weight, and preferably well above 30% by weight. It is appreciated the present fuel additive is useful in all seasonal blends of on and off highway diesel fuel, with any and all levels of biodiesel. It is also be useful in the heavier diesel fuel (D4) used in railroad and marine applications. It is also appreciated the present fuel additive may be utilized in heating oil based upon the same enhanced atomization mechanism described below. The performance benefit is not limited to diesel fuel additive compositions composed of terpenes but is more broadly observed in diesel fuel additive compositions composed of certain cyclic dienes and cyclic trienes that may or may not be terpenes.

As disclosed in Applicant's own U.S. Pat. No. 8,470,058, 1-methyl-4 (1-methylethenyl)-cyclohexene and 2 ethylhexyl nitrate provide a performance benefit in medium and heavy duty diesel engines when the ratio of the 2 ethylhexyl nitrate to terpene (1-methyl-4 (1-methylethenyl)-cyclohexene) ranged from 25 wt. %:75 wt. % to 10 wt. %:90 wt. %. Testing had indicated that higher amounts of 2 ethylhexyl nitrate increased the risk of over-advancing combustion and also providing the opportunity for a greater production of harmful $NO_x$.

However, recent testing in late model medium and heavy duty engines has surprisingly shown that higher concentrations of 2 ethylhexyl nitrate along with a reduced amount of terpenes, such as the cyclic diene, 1-methyl-4 (1-methylethenyl)-cyclohexene, are very effective in providing performance benefits. Further testing has also revealed 1) that the performance benefit is not limited to terpenes and 2) that certain nitro-organics can provide benefits similar to 2 ethylhexyl nitrate without imposing the risk of raising the cetane content of diesel or biodiesel fuel too high.

As described in U.S. Pat. No. 8,470,058, 1-methyl-4 (1-methylethenyl)-cyclohexene is well known to thermally crack into two moles of isoprene (methyl butadiene) at high temperature. It was also known that other non-terpene molecules, such as cyclohexene, thermally crack into two molecules but only one of which is chain branching. The other molecule is typically a chain terminating molecule such as ethylene. Cyclohexene has been found not to deliver any performance benefits.

In accordance with the present invention, it is now appreciated that other molecules that thermally crack into only chain branching radicals also provide performance benefits when combined with 2 ethylhexyl nitrate. The data in the Examples presented below show that the cyclic diene norbornadiene, the cyclic diene 1-methyl-4 (1-methylethylenyl)-cyclohexene, and/or the cyclic triene cyclododecatriene together with 2 ethylhexyl nitrate (at higher concentrations than disclosed in the '058 patent) provide benefits similar to those observed with 1-methyl-4 (1-methylethenyl)-cyclohexene/2 ethylhexyl nitrate as contemplated in Applicant's U.S. Pat. No. 8,470,058. This data lead to the conclusion that the performance benefits are broadly found in the family of chemistries that yield chain branching chemistries such as butadiene, pentadiene and hexadiene. Such was not previously appreciated.

Since the development of the additive disclosed in Applicant's prior U.S. Pat. No. 8,470,058, it is appreciated that diesel fuel has changed significantly and also late model engines differ significantly from the combustion bomb and engines tested during the development of the invention embodied in U.S. Pat. No. 8,470,058. Very high pressure fuel injection equipment, smaller nozzle orifices and multiple fuel injection events per stroke have been introduced into the marketplace. Without being limited in any way, it is believed that these changes to the combustion environment favor a higher ratio of organo-nitrate and/or nitro-organic compound, for example, 2 ethylhexyl nitrate, to 1-methyl-4 (1-methylethenyl)-cyclohexene, norbornadiene, or cyclododecatriene. The smaller drops created by the changes in fuel injection equipment along with the reduced amount of fuel injected early, minimize the effect in the pre-mixed combustion phase as described in U.S. Pat. No. 8,470,058.

The introduction of the organo-nitrate and/or nitro-organic compounds and the cyclic diene and/or cyclic triene, as contemplated in accordance with the present invention, into the high pressure fire in the later mixing-controlled combustion phase (5 to 30 crank angle degrees after the pre-mixed combustion phase) most likely generates a micro-explosion inside the fuel droplet as opposed to earlier single injection engines where the nitrate is flashed off as a gas as the fuel first enters the combustion chamber. The heat release and gas expansion from this process is sufficiently rapid to cause the atomization of the heavier hydrocarbons. A larger amount of $NO_2$ (from the nitrate), closer to a mole to mole concentration with the butadiene (generated from the diene or triene), will therefore have a more beneficial effect in the newer engines by completing combustion earlier whereas a higher concentration of the nitrate could be harmful in an older engine by starting up combustion and pressure rise process before the piston hits top dead center. Additionally, the severe hydrodesulfurization of diesel fuel along with the addition of up to 10% biodiesel to traditional diesel fuel have increased the cetane number of the commercially available diesel fuel such that the mechanism as speculated in U.S. Pat. No. 8,470,058 is no longer relevant. The low cetane components of the fuel (aromatics in particular) have been removed from the fuel eliminating any possible impact on combustion of earlier evaporation of heavier components.

Reinforcing this conclusion is Applicant's current appreciation that the greatest performance benefit is found with the heavier cyclododecatriene. The boiling point of cyclododecatriene is close to the fuel mid-point distillation whereas the other beneficial compounds are near the initial boiling point of the fuel. Half of the fuel would have already evaporated before the cyclododecatriene, significantly reducing its benefit, if the mechanism was a pre-mixed combustion phase reaction.

The mixing-controlled phase reaction is assisted by the close proximity of the cyclic diene/cyclic triene to the nitrate. It is well known that certain organic compounds can be attracted to other certain organic compounds in solution. Crankcase engine oils, for example, include dispersants whose role is specifically to pair up organic and inorganic by-products of combustion contained in the blow by gases. The reasons for the attraction are many but include dipole to dipole attraction, van der Waals forces, pi bond stacking. Certain nitro-organic compounds exhibit a predisposition to donate protons. For example, nitromethane has a pKa of 10, 2-nitropropane has a pKa of 7 and nitrobenzene has a pKa of 3.98. 2-ethylhexyl nitrate, a common diesel fuel cetane improver, has a pKa of 25. Organic compounds with an inherent acidity can, in a non-polar system, be attracted to other organic compounds with a raised affinity for protons. Nitro-organic compounds can also be attracted to unsaturated hydrocarbons through pi bond stacking.

Compounds such as cyclododecatriene, norbornadiene and 1-methyl-4-(1-methylethenyl)-cyclohexene, while intrinsically safe at ambient temperatures, thermally decompose at high temperatures to create highly-reactive subspecies such as butadiene. Depending on oxygen availability, these compounds can enhance combustion/oxidation reactions, completing the combustion event faster, providing higher thermal efficiency. These compounds also exhibit significant proton affinity and also have pi bonds. When organo-nitrates and/or nitro-organic compounds pair with these cyclic-dienes and trienes, the pairs then demonstrate a performance synergy beyond that of the individual combined components by providing a nearby source of highly reactive oxygen (air is only 20% oxygen, 79% nitrogen) initiating these explosive reactions. The benefit is particularly valuable in a diesel engine, where the fuel is injected into the combustion chamber very late in the compression stroke allowing very little time for atomization (liquid fuel does not burn) and mixing of the fuel with the air (without air, the fuel will pyrolize, consuming heat and creating soot). These local micro-explosions rapidly disperse the liquid fuel spray, atomizing and mixing the heavier fuel components with the hot bulk air generated by the heat of compression. This decreases the amount of the fuel that burns as a diffusion flame, thus accelerating the heat release and pressure build. When the heat release period is compressed, thermal efficiency is significantly improved.

Compositions of the Invention

The present diesel fuel (or biodiesel fuel) additive is composed of a combination of a specific selection of unsaturated cyclic hydrocarbons together with specific organo-nitrates and/or nitro-organics. Specifically, the hydrocarbons are cyclic dienes and/or cyclic trienes. The preferred hydrocarbons are 1-methyl-4 (1-methylethenyl)-cyclohexene, norbornadiene and cyclododecatriene. The preferred nitro-organics are nitrobenzene and nitrophenol. The preferred organo-nitrate is 2 ethyl hexyl nitrate.

Utility

The present diesel fuel additive provides a means to significantly upgrade the performance of a medium or heavy duty diesel engine without changing the safety characteristics of the fuel or without changing engine hardware. Further benefits may be derived by optimizing engine calibrations when using this invention.

EXAMPLES

The following examples are offered to illustrate, but not to limit the claimed invention.

Example 1

A 2011 Ford F350 medium duty truck with a 6.7 liter Ford Powerstroke engine was tested on a 52 mile circular loop on an interstate highway. The engine was operated at a steady state condition of 62 miles per hour. Trip fuel economy as displayed by the engine on board computer was recorded. Shown in Table 1 is the large improvement in fuel economy when the truck was operated using the higher ratio (when compared to U.S. Pat. No. 8,470,058) of 2 ethylhexyl nitrate to 1-methyl-4-(1-methylethenyl)-cyclohexene (34/66 wt. %) at a total fuel treat rate of 2000 (wt.) ppm when compared with unadditized base fuel. The truck was operated on each fuel for a minimum of two runs. As used herein the fuel treat rate is determined by adding together the weights of all the additive components making up the fuel additive and dividing that sum by the weight of all the additive components of the fuel additive plus the weight of the fuel. It may also be thought of as being blended wherein 1000 ppm=0.1 wt. %. A total of eleven unadditized base fuel runs were conducted with a 95% confidence interval of +/−0.67%. The data recorded indicate that when any of the formulation components are utilized individually, no benefit is imparted.

TABLE 1

| Formulation | Improvement, % |
|---|---|
| Unadditized | |
| 2 EHN/1-methyl-4-(1-methylethenyl)-cyclohexene | 7.7 |
| 2EHN only | −0.8 |
| 1-methyl-4-(1-methylethenyl)-cyclohexene only | −3.5 |

Example 2

Maximum available torque testing (equivalent to wide open throttle) was conducted using a 2013 John Deere 4.5 liter engine coupled to a 175 HP generator. The load was provided by a precision resistive load bank. The data in the table represent an average of six data samples taken over a 20 minute period. Engine operating data is shown in Table 3. The engine was governed at 1800 rpm to produce 60 hertz power. Load was added to pull the engine speed down below 1800 rpm indicating that the governor could not add any more fuel to make power. For reference, the formulation as contained in U.S. Pat. No. 8,470,058 was also evaluated. Test data shown in Table 2 show that when a 69 wt. % 1-methyl-4 (1-methylethenyl)-cyclohexene/31 wt. % 2 ethyl hexyl nitrate blend is added to B20 (20% by volume biodiesel/80% by volume ultra-low sulfur diesel fuel) at 2500 (wt.) ppm, an improvement over as-built maximum available torque is measured.

TABLE 2

| 1-methyl-4-(1-methylethenyl)-cyclohexene concentration wt. % | 2 ethyl hexyl nitrate concentration wt. % | Improvement in torque over unadditized base fuel (lbs-ft) |
|---|---|---|
| 82 | 18 | 6 |
| 69 | 31 | 5 |

TABLE 3

| Parameter | Measurement |
|---|---|
| Engine speed, rpm | 1754 |
| Engine Load, % | 94 |
| Coolant temperature, ° F. | 190 |
| Exhaust gas temperature, ° F. | 796 |
| Intake air temperature, ° F. | 116 |

Example 3

A ten day, long haul on-highway test was conducted using six Mack 25 ton dump trucks to test the partial substitution of nitrobenzene for 2 ethylhexyl nitrate (to reduce the adverse impact of too much cetane). The fuel in four of the trucks was treated with a fuel additive with a ratio by weight percent of 14% nitrobenzene/26% 2 ethylhexyl nitrate and 60% 1-methyl-4-(1-methylethenyl)-cyclohexane. Two of the trucks remained on unadditized diesel fuel. The fully loaded trucks traveled on the interstate highway one hundred and eighty five miles in each direction, daily. All six trucks followed the same route. The trucks' speed was governed to not exceed sixty five mph. After ten days, the fuel economy of the four trucks operating on the additized fuel increased from an average of 4.6 mpg to 5.17 mpg for an average of 12.4% improvement in fuel economy while the two unadditized trucks experienced a loss in fuel economy, 9.5% for one and 2.5% for the other.

Example 4

A 2008 Ford F250 with a 6.4 liter Navistar Powerstroke engine was operated on a two lane highway for thirty miles in each direction at an average speed of fifty five mph. The truck was first operated on unadditized diesel fuel for two runs. The fuel was then additized with the same fuel additive blend as in Example 3 (14 wt. % nitrobenzene/26 wt. % 2 ethylhexyl nitrate and 60 wt. % 1-methyl-4-(1-methylethenyl)-cyclohexene. The fuel economy of the truck improved from 18 mpg to 20.17 mpg for an 11.9% benefit.

Example 5

Testing in the same engine as Example 2 at the same conditions described in Table 3 was conducted using various nitro-aromatics with various cyclic dienes/trienes. The torque improvements compared to unadditized base fuel are show in Table 4.

TABLE 4

| Organo-nitro compound | Concentration (ppm) | Hydrocarbon | Concentration (ppm) | Increase in maximum torque over unadditized base fuel, lbs-ft |
|---|---|---|---|---|
| Nitropropane | 1400 | cyclododecatriene | 2000 | 13 |
| Nitropropane | 1400 | bicyclo[2.2.1] hepta-2,5-diene | 2000 | 21 |

TABLE 4-continued

| Organo-nitro compound | Concentration (ppm) | Hydrocarbon | Concentration (ppm) | Increase in maximum torque over unadditized base fuel, lbs-ft |
|---|---|---|---|---|
| Nitrobenzene | 2000 | bicyclo[2.2.1] hepta-2,5-diene | 2000 | 6 |
| Nitromethane (with co-solvent) | 1000 | cyclododecatriene | 2000 | 8 |

Preferred Embodiments

As explained above, the present diesel fuel additive is composed of a combination of a specific selection of unsaturated cyclic hydrocarbons together with specific organo-nitrates and/or nitro-organics. Specifically, the hydrocarbons are cyclic dienes and cyclic trienes. The preferred hydrocarbons are 1-methyl-4 (1-methylethenyl)-cyclohexene, norbornadiene and cyclododecatriene. The preferred nitro-organics are nitrobenzene nitropropane, nitrophenol, and nitromethane. The preferred organo-nitrate is 2 ethylhexyl nitrate.

The present diesel fuel additive includes 50 wt. % to <75 wt. % (preferably 50 wt. % to 70 wt. %) cyclic dienes and/or cyclic trienes that thermally crack into only chain branching radicals and >25 wt. % to 50 wt. % (preferably 30 wt. % to 50 wt. %) organo-nitrates and/or nitro-organics. The diesel fuel additive composition is combined with the fuel at a combined treat rate ranging from 1000 (wt.) ppm to 3000 (wt.) ppm. As shown above in the Examples, the nitro-organics and organo-nitrates may be mixed as desired while still achieving the goals of the present invention. Similarly, the cyclic dienes and cyclic trienes may be mixed as desired while still achieving the goals of the present invention.

Particularly, and in accordance with a representative embodiment, the diesel fuel (or biodiesel fuel) additive comprises 50 wt. % to <75 wt. % (preferably, 50 wt. % to 70 wt. %) of a cyclic diene or cyclic triene and >25 wt. % to 50 wt. % (preferably 30 wt. % to 50 wt. %) of a nitro-organic compound at a combined treat rate ranging from 1000 (wt.) ppm to 3000 (wt.) ppm when added to the diesel fuel or biodiesel fuel. The nitro-organic compound is selected from the group consisting of nitrobenzene, nitropropane, nitrophenol, and nitromethane.

In accordance with another representative embodiment, the diesel fuel (or biodiesel fuel) additive comprises 50 wt. % to <75 wt. % (preferably 50 wt. % to 70 wt. %) of a cyclic diene and/or cyclic triene that splits into two chain branching radicals upon decomposition, and >25 wt. % to 50 wt. % (preferably 30 wt. % to 50 wt. %) of any octyl or heavier nitrate at a combined treat rate ranging from 1000 (wt.) ppm to 3000 (wt.) ppm when added to the fuel. More particularly, the diesel fuel (or biodiesel fuel) additive composition comprises 50 wt. % to <75 wt. % (preferably 50 wt. % to 70 wt. %) of a cyclic diene or cyclic triene that splits into two chain branching radicals upon decomposition, and >25 wt. % to 50 wt. % (preferably 30 wt. % to 50 wt. %) 2 ethyl hexyl nitrate at a combined treat rate ranging from 1000 (wt.) ppm to 3000 (wt.) ppm when added to the diesel fuel (or biodiesel fuel).

An exemplary mixing of the present fuel additive with a diesel fuel is disclosed in FIG. 1.

While the preferred embodiments have been shown and described, it will be understood that there is no intent to limit the invention by such disclosure, but rather, it is intended to cover all modifications and alternate constructions falling within the spirit and scope of the invention.

The invention claimed is:

1. A fuel additive, comprising:

50 wt. % to 70 wt. % cyclic dienes and/or cyclic trienes that thermally crack into only chain branching radicals; and >25 wt. % to 50 wt. % organo-nitrates and/or nitro-organics;

wherein the fuel additive ranges from 1000 (wt.) ppm to 3000 (wt.) ppm when combined with a fuel.

2. The fuel additive according to claim 1, including 30 wt. % to 50 wt. % organo-nitrates and/or nitro-organics.

3. The fuel additive according to claim 2, wherein the cyclic diene is 1-methyl-4 (1-methylethenyl)-cyclohexene or norbornadiene.

4. The fuel additive according to claim 2, wherein the cyclic triene is cyclododecatriene.

5. The fuel additive according to claim 1, wherein the cyclic dienes and/or cyclic trienes are selected from the group consisting 1-methyl-4 (1-methylethenyl)-cyclohexene, norbornadiene and cyclododecatriene.

6. The fuel additive according to claim 5, wherein the nitro-organics and/or organic nitrates are selected from the group consisting of nitrobenzene nitropropane, nitrophenol, nitromethane, and 2 ethylhexyl nitrate.

7. The fuel additive according to claim 1, wherein the nitro-organics and/or organic nitrates are selected from the group consisting of nitrobenzene nitropropane, nitrophenol, nitromethane, and 2 ethylhexyl nitrate.

8. The fuel additive according to claim 1, wherein the nitro-organics are nitrobenzene nitropropane, nitrophenol, and/or nitromethane.

9. The fuel additive according to claim 1, wherein the organo-nitrate is 2 ethylhexyl nitrate.

10. The fuel additive according to claim 5, wherein the nitro-organics are nitrobenzene nitropropane, nitrophenol, and/or nitromethane.

11. The fuel additive according to claim 5, wherein the organo-nitrate is 2 ethylhexyl nitrate.

12. A diesel fuel or biodiesel fuel with a fuel additive, comprising:

a diesel fuel or biodiesel fuel;

a fuel additive, comprising:

50 wt. % to 70 wt. % cyclic dienes and/or cyclic trienes that thermally crack into only chain branching radicals; and >25 wt. % to 50 wt. % organo-nitrates and/or nitro-organics;

wherein the fuel additive ranges from 1000 (wt.) ppm to 3000 (wt.) ppm in the diesel fuel or biodiesel fuel.

13. The diesel fuel or biodiesel fuel with a fuel additive according to claim 12, including 30 wt. % to 50 wt. % organo-nitrates and/or nitro-organics.

14. The diesel fuel or biodiesel fuel with a fuel additive according to claim 13, wherein the cyclic diene is 1-methyl-4 (1-methylethenyl)-cyclohexene or norbornadiene.

15. The diesel fuel or biodiesel fuel with a fuel additive according to claim 13, wherein the cyclic triene is cyclododecatriene.

16. The diesel fuel or biodiesel fuel with a fuel additive according to claim 12, wherein the cyclic hydrocarbons are selected from the group consisting 1-methyl-4 (1-methylethenyl)-cyclohexene, norbornadiene and cyclododecatriene.

17. The diesel fuel or biodiesel fuel with a fuel additive according to claim 16, wherein the nitro-organics and/or organic nitrates are selected from the group consisting of nitrobenzene nitropropane, nitrophenol, nitromethane, and 2 ethylhexyl nitrate.

18. The diesel fuel or biodiesel fuel with a fuel additive according to claim 12, wherein the nitro-organics and/or organic nitrates are selected from the group consisting of nitrobenzene nitropropane, nitrophenol, nitromethane, and 2 ethylhexyl nitrate.

19. The diesel fuel or biodiesel fuel with a fuel additive according to claim 12, wherein the nitro-organics are nitrobenzene nitropropane, nitrophenol, and/or nitromethane.

20. The diesel fuel or biodiesel fuel with a fuel additive according to claim 12, wherein the organo-nitrate is 2 ethylhexyl nitrate.

* * * * *